United States Patent [19]

Weiss et al.

[11] 4,189,406

[45] Feb. 19, 1980

[54] METHOD FOR HOT-PRESSING PHOTOCONDUCTORS

[75] Inventors: Armin K. Weiss; Edward Carnall, Jr., both of Rochester, N.Y.

[73] Assignee: Eastman Kodak Company, Rochester, N.Y.

[21] Appl. No.: 439,653

[22] Filed: Feb. 4, 1974

[51] Int. Cl.[2] ..... G03G 5/04

[52] U.S. Cl. ..... 252/501.1; 264/332; 264/345

[58] Field of Search ..... 264/61, 332, 125, 104, 264/1, DIG. 25, 234, 345; 252/501; 96/1.5; 106/73.3

[56] References Cited

U.S. PATENT DOCUMENTS

| | | | |
|---|---|---|---|
| 2,651,700 | 9/1953 | Gans | 264/332 |
| 3,131,238 | 4/1964 | Carnell | 264/332 |
| 3,307,983 | 3/1967 | DeHaan et al. | 252/501 |
| 3,543,025 | 11/1970 | Stanton | 252/501 |
| 3,577,272 | 5/1971 | Reithel | 252/501 |
| 3,639,132 | 2/1972 | Egerton et al. | 106/73.3 |
| 3,681,071 | 8/1972 | Donald | 96/1.8 |

OTHER PUBLICATIONS

Sittig, *Photoconductive Materials,* pp. 35–43, 188, 122 (1970).

*Primary Examiner*—John A. Parrish
*Attorney, Agent, or Firm*—Warren W. Kurz

[57] ABSTRACT

Highly densified, polycrystalline photoconductors can be produced by hot-pressing various materials, such as powdered lead monoxide. The powdered material is subjected to a temperature and pressure for a length of time sufficient to form a photoconductive element having a density of at least 85% and up to and including the theoretical density of the material. Such formed photoconductive element or material can be utilized in electro-photographic applications and, with the exception of such material in its single crystal form, will exhibit increased absorption of activating radiation, increased signal-to-noise ratios, and improved spatial frequency response in comparison with presently known photoconductive elements or materials.

8 Claims, 2 Drawing Figures

METHOD FOR HOT-PRESSING PHOTOCONDUCTORS

FIELD OF THE INVENTION

The invention relates to an improved method for producing photoconductors and, more particularly, for producing photoconductive elements or materials by the hot-pressing of powdered polycrystalline materials, such as, lead monoxide.

DESCRIPTION OF THE PRIOR ART

Typical prior art photoconductors are produced, for example, by the evaporation of lead oxide in layers on a suitable support. Such layers are not fully satisfactory due to porosity, lumps, pinholes and low adherence to the support. Because of these inadequacies, the photoconductive material will exhibit poor photoconductivity, poor radiation response, low signal-to-noise ratios, mechanical instability and, hence, physical break-down by crumbling, flaking, chipping and cracking. Photoconductive materials can also be produced by a slurry solution process. However, when a photoconductive material prepared in this way is applied to a support, it will also exhibit pinholes, coarse crystals, nonuniform dispersion, poor adhesion to the support and generally low photoresponse with relatively high dark current which severely limits the use thereof under ambient light conditions. Photoconductive layers can also be prepared by sputtering a layer of lead monoxide onto a support as described in U.S. patent application Ser. No. 259,705 filed June 5, 1972 in the names of Armin K. Weiss and Robert G. Spahn and entitled "Method for Producing a Photoconductive Element and the Product Resulting Therefrom" now U.S. Pat. No. 3,832,298, issued Aug. 27, 1974. The layers produced by this process are typically 10 microns or less and are, therefore, too thin for radiographic applications.

SUMMARY OF THE INVENTION

One object of the invention is to provide a method of hot-pressing materials, such as lead monoxide, for producing a photoconductor having enhanced response to electromagnetic activating radiation.

Another object of the invention is to provide a new, self-supporting, mechanically strong, highly densified, photoconductive material.

Yet another object of the invention is to provide photoconductive materials having improved spatial frequency response and improved signal-to-noise ratios.

Still another object of the invention is to provide a photoconductive material, such as lead monoxide, having improved radiation response characteristics for application in electroradiography.

And still another object of the invention is to provide photoconductive materials which are resistant to mechanical abrasion and to chemical deterioration.

Other objects and advantages will be apparent to those skilled in the art from the more detailed description and examples set forth hereinbelow.

As will be apparent from the description of the invention hereinafter, the photoconductive material produced in accordance with the invention shows increased absorption to activating radiation, increased signal-to-noise ratio and improved spatial frequency response when compared with presently known photoconductive materials.

In accordance with the invention, there is provided a method for forming highly densified photoconductive materials in which the photoconductive materials in powdered form are hot-pressed. Powdered photoconductive materials, such as lead monoxide, can be hot-pressed to a density of from at least 85% up to and including the theoretical density of the materials. The photoconductive material so formed can be utilized in electrographic applications and, with the exception of such material in its single crystal form, will exhibit increased absorption of activating radiation, increased signal-to-noise ratios, and improved spatial frequency response. In accordance with the invention, the powdered materials are hot-pressed at temperatures and pressures within certain ranges and for predetermined lengths of time. In addition, the hot-pressed material can be postfired in an air or other gas or vapor environment of a predetermined temperature range for a specified length of time to provide improved insulating properties, higher translucency, homogeneity, or other such desirable characteristics.

DESCRIPTION OF THE DRAWING

Reference is now made to the accompanying drawing wherein.

DESCRIPTION OF THE PREFERRED EMBODIMENT

Figure 1:
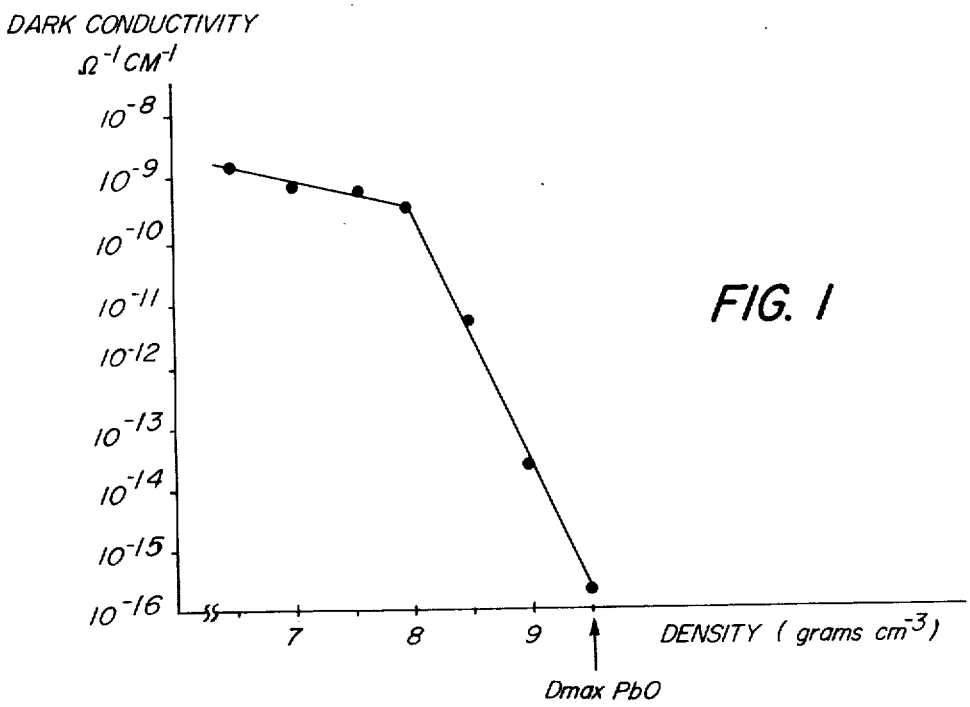
FIG. 1 is a graphical showing of dark conductivity versus density for hot-pressed lead monoxide in accordance with the present invention.
Figure 2:
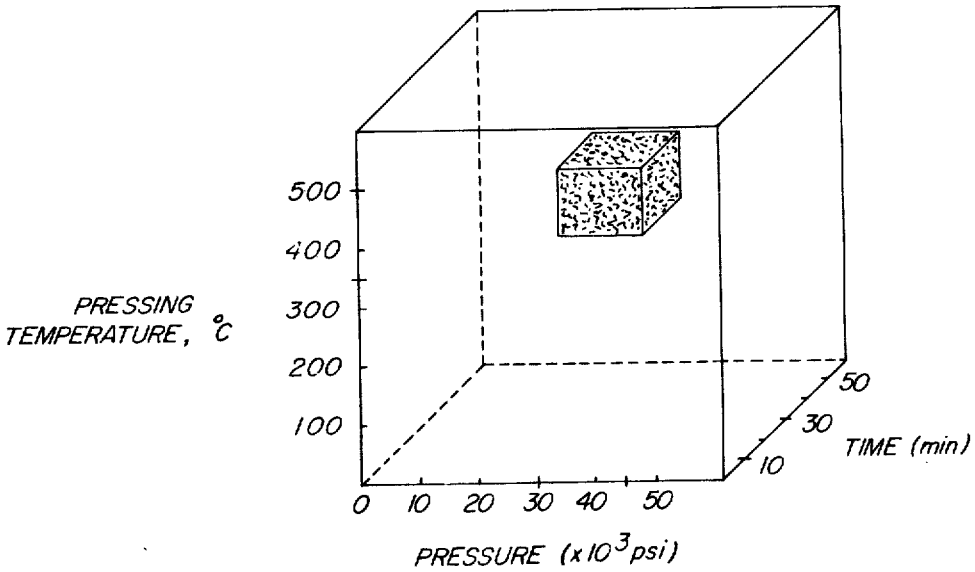
FIG. 2 is a diagrammatic perspective view showing the preferred ranges for the hot-pressing parameters of heat, pressure, and time for lead monoxide when hot-pressed in accordance with the invention.

With reference particularly to FIG. 1, the dependence of the dark conductivity on the density of a hot-pressed photoconductive material, such as lead monoxide, is shown in graph form. The graph shows that hot-pressing photoconductive lead monoxide up to a density of approximately 8.0 produces a photoconductive material having a relatively high dark current, i.e., approximately $1\times10^{-9}$ ohm$^{-1}$ cm$^{-1}$. However, if hot-pressing is continued to produce a photoconductive material having a density of from about 8.0 to approximately 9.5, the theoretical density of lead monoxide, such photoconductive material will exhibit markedly lower dark conductivity, i.e., by as much as seven orders of magnitude or $1\times10^{-16}$ ohm$^{-1}$ cm$^{-1}$. Similar characteristics are observed when other powdered, photoconductive, polycrystalline materials disclosed in the following examples are hot-pressed into a photoconductive material or element in accordance with the teachings of the present invention. The preferred ranges of temperature, pressure, and time for lead monoxide are shown diagrammatically in FIG. 2. It will be understood by those skilled in the art that the disclosed ranges are illustrative and can be extended beyond the limits shown in FIG. 2 to still produce a highly densified photoconductive material. For example, the use of a higher pressure will provide for the use of a lower temperature for approximately the same time duration. Similarly, a lower pressure can be used with a higher temperature and an increased time. Typical apparatus and a cycle of operation for the hot-pressing of powdered lead monoxide would be as follows:

The base of a 2" inside diameter mold is covered with a 2" diameter disc of platinum, 0.01 inch thick. 60 grams of lead monoxide are poured over the disc and lightly tapped. A second platinum disc is placed on top of the powder surface. A cylinder, slightly under 2" in outside diameter, is set on the top of the second platinum disc. This assembly is placed concentrically within an array of induction-heating coils and between the plates of a hydraulic press that is capable of producing a force of up to about 1,000 tons. The entire assembly is now heated to 450° C. in air, vacuum or an inert gas as indicated by a monitor embedded in the mold. While the temperature is maintained at the 450° C., the press is set to apply a pressure of approximately 30,000 psi to the assembly for about 20 minutes, after which the pressure is removed. The heating is then discontinued and the hot sample is removed from the mold. After the sample has cooled, its surfaces are smoothed with fine sandpaper and polished on a felt wheel. The sample is approximately 3 mm thick and is transluscent to light from a tungsten source.

The mold material can be of molybdenum or of materials referred to as super-alloys, such as Waspaloy, which is a registered trademark of Special Metals, Inc., New Hartford, New York, for a high temperature alloy. Also, discs of aluminum oxide ($Al_2O_3$), of boron nitride (BN) or of a similar inert material can be used in place of the discs of platinum.

The temperature conditions under which tetragonal and orthorhombic lead monoxide, as well as a mixture thereof, can be hot-pressed in air range from about 300° C. to about 550° C. and, preferably, from between about 350° C. to about 500° C. The pressure ranges can be between about 10,000 psi and about 55,000 psi and, preferably, between 30,000 psi and 45,000 psi. The pressing time can range from about 5 minutes to about 45 minutes with a preferable time span of from between about 10 minutes to about 30 minutes. The thickness of a photoconductor that can be produced will range from about 0.5 mm to 5 mm. Lead monoxide photoconductors prepared in accordance with the invention are rigid, mechanically stable and exhibit electrical response upon exposure to radiation in the visible, ultraviolet and X-ray regions of the spectrum. Most lead monoxide samples so produced were translucent even at 3 mm thickness, under tungsten light.

The properties, such as conductivity and sensitivity, of the lead monoxide photoconductive material produced in this manner can be changed by post-firing in air, in an inert gas, or in vapors, such as vapors of hydrochloric acid or of hydrogen sulfide. Such post-firing is in a temperature range of from about 300° C. to about 850° C. for a period of time of between about one hour and approximately 50 hours. For example, post-firing in oxygen of an oxide photoconductive material pressed originally in air, vacuum, or an inert gas affords a reoxidation of the partially oxygen-deficient material. Generally, this is accompanied by an improvement of the insulating properties and by higher translucency.

The use of powdered lead monoxide doped with ions of lithium, silver, sulfur, and antimony will provide a photoconductor having a modified electrical response. Sulfur-doped, lead monoxide, when hot-pressed into a photoconductor, will possess a spectral response extending into the near-infrared region of the spectrum and increased electrical conductivity compared to that of undoped lead monoxide. Lithium-doped, lead monoxide, photoconductors will exhibit a 2-to 5-fold increase in sensitivity to activating radiation, depending upon the dopant concentration.

Hot-pressing of a photoconductive material in accordance with the invention is a method by which a photoconductive layer can be obtained in any desirable thickness or shape for use, for example, in an electrographic application. Also, by fabricating a photoconductive material in accordance with the invention, the size and shape of the layer can be such that they cannot be produced by single crystal growth of the material nor by any other known prior art method. Any limitation as to size and/or shape of the layer will be imposed primarily by the pressing apparatus per se.

Since high densification is achieved by hot-pressing in accordance with the invention an decreased dark conductivity in the photoconductive material results therefrom, when compared to prior art photoconductive materials, an increased capability for detecting low-level signals can and is realized by the photoconductive material produced in accordance with the invention.

The following examples will serve to illustrate the method set forth by the invention; however, these examples are to be considered as being illustrative of the invention and not as limitations thereof.

EXAMPLE 1

A 2 inch diameter mold was charged with 62 grams of powdered predominantly orthorhombic lead monoxide and heated to approximately 350° C. in air. While the temperature was maintained constant, a pressure of approximately 30,000 pounds per square inch (psi) was applied for about 30 minutes. The pressed sample was then removed and allowed to cool to room temperature under ambient conditions. After polishing the surfaces on a felt wheel, the sample appeared orange-brown. It was approximately 2.8 millimeters (mm) thick and slightly translucent to light from a microscope illuminator.

A nearly opaque metallic electrode, approximately 6.5 mm in diameter, was deposited on corresponding areas of the surfaces of the sample by conventional vapor deposition techniques in a vacuum system. Gold was used as the evaporant.

The sample was then placed inside a grounded metal box and one gold electrode was connected to the positive terminal of an electrical potential source, the negative terminal of which was grounded. The opposite gold electrode was connected to a sensitive current meter. A potential of 1000 volts was applied to the sample. In the "dark" (absence of activating radiation), a dark current of $1\times10^{-10}$ amps was flowing in the circuit. Under the 1000 volt potential, when light from a microscope illuminator, placed at approximately 2 inches from the sample, was directed at either one of the gold electrodes, a current of $5\times10^{-8}$ amps was recorded. Upon removal of the light the current decreased rapidly to its original dark value.

EXAMPLE 2

Example 1 was repeated, except that the temperature during pressing was held at approximately 430° C. The resultant sample appeared orange-yellow and was highly translucent. With application of a potential of 1000 volts the dark current was approximately $1\times10^{-11}$ amps and the current under the same potential under exposure to light rose to $2\times10^{-8}$ amps.

EXAMPLE 3

Example 1 was repeated except that the temperature during pressing was held at approximately 510° C. The resultant sample appeared green-grey and was opaque to visible radiation. With the application of 1000 volts, the dark current was $1\times10^{-3}$ amps and no change in current was observed under illumination.

EXAMPLE 4

The electrodes were removed from the Example 3 sample by sanding. The sample was placed in an open quartz dish which was inserted into the open tube of a high temperature electric furnace. The sample was heated to about 600° C. in air and remained at that temperature for approximately 4 hours. Upon removal and cooling to room temperature, the sample appeared yellow-orange. It was highly translucent to tungsten light. Gold electrodes were deposited by evaporation. With the application of 1000 volts, the dark current was $3\times10^{-11}$ amps and the current under exposure to light from the microscope illuminator rose to $5\times10^{-7}$ amps.

EXAMPLE 5

Example 1 was repeated except that the starting material was powdered tetragonal lead monoxide, prepared from Evans Fumed Litharge by following Example 1 in U.S. Pat. No. 3,577,272. The temperature was held at approximately 450° C. during pressing. The sample appeared orange-red and was highly translucent.

Upon application of 250 volts, the dark current was $5\times10^{-11}$ amps, and under light exposure the current increased to $1\times10^{-8}$ amps. When the sample was exposed to X-rays from an industrial X-ray source set at 100 kilovolts (kV), 5 milliamperes (mA) and spaced approximately 50 inches from the photoconductor, the current increased to $1\times10^{-9}$ amps.

EXAMPLE 6

Example 1 was repeated, except that the applied pressure was 20,000 psi and the temperature was 450° C. After being allowed to cool, the sample was ground to a thickness of 0.25 mm and gold electrodes were deposited thereon as in Example 1.

At an applied potential of 250 volts, a dark current of $2\times10^{-11}$ amps was measured. Under X-ray exposure of 100 kV, X-rays at a dose rate of about 80 milliRads per second (mR/sec), the current increased to $8\times10^{-10}$ amps. Under X-ray exposure of 250 kV X-rays, at a dose rate of about 80 mR/sec, the current was $3\times10^{-9}$ amps, decreasing rapidly to the dark current value upon removal of the X-radiation.

Measurements showed that at a thickness of approximately 0.25 mm, lead monoxide samples formed in accordance with the present invention stop approximately 90% of incident 100 kV X-rays. A layer of 0.3 mm overall thickness, prepared by the prior art method following Example 1, U.S. Pat. No. 3,577,272, for dispersion of lead oxide powder in a binder, stops less than 50% of the incident X-rays due to lower active lead oxide content.

EXAMPLE 7

Ten grams of powdered bismuth trioxide was poured into a 1 inch diameter mold. The assembly was partially evacuated to a gas pressure of approximately $3\times10^{-2}$ Torr, heated to approximately 500° C. and pressed at about 30,000 psi for approximately 5 minutes.

The sample appeared pale yellow and was translucent. After both surfaces had been ground, the sample was approximately 0.5 mm thick. An electrode was applied to each surface by spreading a thin film of silver paint over the surfaces. Following a 4 hour period to allow the paint to dry, a potential of 1,000 volts was applied across the electrodes. A dark current of $1\times10^{-9}$ amps was measured. When light from a microscope illuminator was directed at either electrode, the current increased to $1\times10^{-8}$ amps.

EXAMPLE 8

A sample of lead monoxide was prepared as in Example 3. At a potential of 1,000 volts, the dark current was $5\times10^{-4}$ amps. No change in current was noted upon exposure to light. The electrodes were removed by polishing. The sample was then placed on a 1 inch thick block of stainless steel held at 40° F. by partial immersion in cold water. An oxygen-rich acetylene flame was directed at the free surface of the sample from a distance of about 3 inches. The flame was swept over the surface several times until the entire surface appeared bright yellow, while the bulk of the sample maintained a green-grey color.

Gold electrodes were redeposited by evaporation and a potential of 1,000 volts was applied. The dark current was $3\times10^{-7}$ amps, if the gold electrode on the yellow surface was connected to the negative terminal of the potential source. The dark current was $4\times10^{-6}$ amps, if the gold electrode on the yellow surface was connected to the positive terminal of the potential source. In both cases the current increased to $1\times10^{-4}$ amps, if the electrode deposited on the yellow surface was exposed to light.

EXAMPLE 9

20 grams of powdered antimony trioxide was poured into a 1 inch diameter mold. The assembly was heated to approximately 450° C. in air and maintained at this temperature while a pressure of about 25,000 psi was applied for about 5 minutes. After cooling, grinding and polishing, the sample was approximately 2.5 mm thick. It appeared grey-white and opaque to tungsten light. Gold electrodes were deposited as in Example 1. Upon application of a potential of 1,000 volts, a dark current of $2\times10^{-9}$ amps was recorded. Upon exposure to a microscope illuminator, the current increased to approximately $8\times10^{-9}$ amps.

EXAMPLE 10

10 grams of powdered antimony trisulfide was poured into a 1 inch diameter mold. The assembly was evacuated to a gas pressure of approximately $3\times10^{-2}$ Torr and heated to approximately 300° C. and held at this temperature while a pressure of approximately 25,000 psi was applied for about 5 minutes. After cooling and grinding and polishing of the sample surfaces, the sample was approximately 1 mm thick. It appeared brown-black and opaque to tungsten light. Gold electrodes were deposited as in Example 1. Upon application of a potential of 1,000 volts, a dark current of $7\times10^{-9}$ amps was recorded. Upon illuminating either one of the electrodes with light from a microscope illuminator, the current increased to $1\times10^{-7}$ amps. This current level decreased rapidly to the dark current level upon removal of the light source.

EXAMPLE 11

A hot-pressed sample of lead monoxide was prepared as in Example 2. After grinding and polishing of the sample surfaces to a thickness of about 0.5 mm, one surface was covered with conducting silver paint. This conductive surface was placed on an electrically grounded aluminum plate. The free surface of the sample was corona-charged in the dark to a potential of about +1,000 volts, for approximately 10 seconds. Following the charging step, the surface was exposed imagewise from a projector to a pattern of light and dark lines, for about 3 seconds. The exposure step was followed by toning the latent electrostatic image, by dipping the sample into a negative liquid electrographic toner for about 10 seconds. Previously unexposed lines were toned black; previously exposed lines showed no toner deposit. Thus, a positive reproduction of the projected image pattern was rendered permanently visible on the sample. Such an image can be transferred to a sheet of paper by contact pressure, if the toner deposit is wet when the paper and image come into contact.

EXAMPLE 12

5 grams of powdered silver iodide was placed in a 1 inch diameter mold and evacuated to a gas pressure of $3\times10^{-2}$ Torr. The assembly was heated to 120° C. and a pressure of 40,000 psi was applied for approximately 15 minutes. After grinding and polishing the surfaces of the sample to a final thickness of 1.4 millimeter, the sample appeared green-grey and was translucent. Gold electrodes were deposited as in Example 1. Upon application of a potential of 1 volt, a dark current of $6\times10^{-5}$ amps was measured. Under exposure to unfiltered light from a microscope illuminator, the current increased to $1\times10^{-4}$ amps.

The invention has been described in detail with particular reference to preferred embodiments thereof, but it will be understood that variations and modifications can be effected within the spirit and scope of the invention.

We claim:

1. A lead monoxide element having a density greater than about 85% of the theoretical density of lead monoxide, said element being produced by the method comprising the steps of:
   (a) placing powdered lead monoxide in a mold formed of a substance inert to said lead monoxide; and
   (b) simultaneously applying heat and pressure to said powdered lead monoxide in said mold for a time period of from about 5 to about 45 minutes, said pressure being in the range of from about 10,000 pounds per square inch to about 55,000 pounds per square inch, and said heat being in the range of from about 300° C. to about 500° C.

2. The element produced by the method of claim 1, said method further comprising the step of post-firing said powdered material, upon the release of pressure, to a temperature in the range of from about 300° C. to about 850° C. for a time period of from about 1 to about 50 hours.

3. A method for producing an electroradiographic element by hot-pressing a powdered, photoconductive, polycrystalline material consisting essentially of lead monoxide to a density of from at least 85% of the theoretical density of such material up to and including the theoretical density, said method comprising the steps of:
   (a) placing said powdered lead monoxide in a mold formed of a substance inert to said lead monoxide; and
   (b) simultaneously applying heat and pressure to said powdered lead monoxide in said mold for a time period of from about 5 to about 45 minutes, said pressure being in the range of from about 10,000 pounds per square inch to about 55,000 pounds per square inch and said heat being in the range of from about 300° C. to about 500° C.

4. The method in accordance with claim 3 wherein said powdered lead monoxide is of the tetragonal form.

5. The method in accordance with claim 3 wherein said powdered lead monoxide is of the orthorhombic form.

6. The method in accordance with claim 3 further comprising the step of post-firing said powdered lead monoxide, upon the release of pressure, to a temperature in the range of from about 300° C. to about 850° C. for a time period of from about 1 to about 50 hours.

7. A method for producing a photoconductive element by hot-pressing a powdered, photoconductive, polycrystalline material consisting essentially of a mixture of tetragonal and orthorhombic lead monoxide to a density of from at least 85% of the theoretical density of such material up to and including the theoretical density, said method comprising the steps of:
   (a) placing said powdered material in a mold formed of a substance inert to said powdered material; and
   (b) simultaneously applying heat and pressure to said powdered material in said mold for a time period of from about 10 to about 30 minutes, said pressure being in the range of from about 30,000 pounds per square inch to about 45,000 pounds per square inch and said heat being in the range of from about 350° C. to about 450° C.

8. The method in accordance with claim 7 further including the step of post-firing said powdered material, upon the release of pressure, within the range of from about 300° C. to about 850° C. for a time period of from about 1 to about 50 hours.

* * * * *